US006148925A

United States Patent [19]

Moore

[11] Patent Number: 6,148,925

[45] Date of Patent: Nov. 21, 2000

[54] METHOD OF MAKING A CONDUCTIVE DOWNHOLE WIRE LINE SYSTEM

[76] Inventor: Boyd B. Moore, 427 Mignon, Houston, Tex. 77024

[21] Appl. No.: 09/249,547

[22] Filed: Feb. 12, 1999

[51] Int. Cl.[7] ..... E21B 19/08; E21B 19/084

[52] U.S. Cl. ..... 166/384; 16/81; 166/65.1; 166/77.1; 166/385; 254/134.3 R

[58] Field of Search ..... 166/65.1, 77.1, 166/77.2, 242.2, 384, 385; 16/81; 254/134.3 FT, 134.3 R

[56] References Cited

U.S. PATENT DOCUMENTS

| | | | |
|---|---|---|---|
| 1,523,629 | 1/1925 | Bullock | 174/108 |
| 1,998,826 | 4/1935 | Wentz | 173/265 |
| 2,018,477 | 10/1935 | Wentz | 173/265 |
| 2,262,364 | 11/1941 | Hugel et al. | 166/77.1 |
| 2,357,906 | 9/1944 | Osterheld | 201/67 |
| 2,936,357 | 5/1960 | Crawford | 219/8.5 |
| 2,950,454 | 8/1960 | Unger | 333/95 |
| 3,016,503 | 1/1962 | Pierce | 333/95 |
| 3,265,803 | 8/1966 | Grove | 174/15 |
| 3,285,629 | 11/1966 | Cullen et al. | 285/119 |
| 3,356,790 | 12/1967 | Polizzano et al. | 174/102 |
| 3,436,287 | 4/1969 | Windeler | 156/54 |
| 3,443,429 | 5/1969 | Terwilliger et al. | 73/152 |
| 3,614,139 | 10/1971 | Harrison et al. | 287/52 |
| 3,638,732 | 2/1972 | Huntsinger et al. . | |
| 3,737,997 | 6/1973 | Davis | 29/624 |
| 3,750,263 | 8/1973 | Satzler et al. | 29/470.3 |
| 3,835,559 | 9/1974 | Kotter | 38/21 |
| 3,897,897 | 8/1975 | Satzler et al. | 228/2 |
| 3,916,685 | 11/1975 | Paap et al. | 73/152 |
| 3,973,715 | 8/1976 | Rust | 228/112 |
| 3,996,019 | 12/1976 | Cogan | 29/191.4 |
| 4,009,754 | 3/1977 | Cullen et al. | 166/77.1 |
| 4,038,519 | 7/1977 | Foucras | 219/301 |
| 4,071,834 | 1/1978 | Comte | 333/95 R |
| 4,075,820 | 2/1978 | Standley | 53/329 |
| 4,083,484 | 4/1978 | Polizzano et al. | 228/130 |
| 4,095,865 | 6/1978 | Denison et al. | 339/16 R |
| 4,121,193 | 10/1978 | Denison | 340/18 CM |
| 4,137,762 | 2/1979 | Smith . | |
| 4,220,381 | 9/1980 | Van Der Graaf | 339/16 C |
| 4,315,099 | 2/1982 | Gerardot et al. | 174/47 |
| 4,317,003 | 2/1982 | Gray | 174/106 R |
| 4,346,256 | 8/1982 | Hubbard et al. | 174/47 |
| 4,365,136 | 12/1982 | Gottlieb | 219/121 LE |
| 4,368,348 | 1/1983 | Eichelberger et al. | 174/47 |
| 4,372,043 | 2/1983 | Cookson | 29/828 |
| 4,415,763 | 11/1983 | Cookson | 174/28 |
| 4,415,895 | 11/1983 | Flagg | 340/856 |
| 4,416,494 | 11/1983 | Watkins et al. | 339/15 |
| 4,496,408 | 1/1985 | Hahn | 156/73.5 |
| 4,515,211 | 5/1985 | Reed et al. | 166/385 X |

(List continued on next page.)

FOREIGN PATENT DOCUMENTS 0791719 8/1997 European Pat. Off. .

OTHER PUBLICATIONS

S.N. 666,846; Moore; Rolled–Formed Seat and Retainer for a Fluid–Tight Ferrule Seal on a Rigid Metal Tube Which is Harder Than the Ferrule, Method and Aparatus; Filed: Jun. 19, 1996.

*Primary Examiner*—George Suchfield
*Attorney, Agent, or Firm*—Fulbright & Jaworski LLP

[57] ABSTRACT

A method for inserting at least one conductor into an elongated length of metal coiled tubing, includes the steps of placing the coiled tubing in a substantially vertical passageway, inserting the conductor into the tubing, the leading end of the conductor including an elongated weight connected to the conductor, which weight is heavy enough to straighten the conductor enough to fall through the tubing, the weight having essentially no stiffness so that it is flexible enough to move through bends or irregularities in the tubing, allowing the conductor and weight to fall by gravity through the tubing, which has a sufficient helical pitch providing a hold-up force due to friction for preventing the conductors from breaking, until the desired length of conductor is inserted in the tubing, and removing the tubing with the conductor inside the tubing from the passageway and winding the tubing on a reel.

24 Claims, 11 Drawing Sheets

U.S. PATENT DOCUMENTS 4,552,432 11/1985 Anderson et al. ..... 350/96.23
4,554,650 11/1985 Brown et al. ..... 367/154
4,555,352 11/1985 Garner et al. ..... 252/35
4,581,926 4/1986 Moore et al. ..... 73/155
4,612,984 9/1986 Crawford .
4,616,705 10/1986 Stegemeier et al. .
4,665,281 5/1987 Kamis ..... 174/102 R
4,673,035 6/1987 Gipson ..... 166/77.1
4,681,169 7/1987 Brookbank, III ..... 166/385
4,682,657 7/1987 Crawford ..... 166/385
4,710,245 12/1987 Roether ..... 148/12.4
4,734,981 4/1988 Ziemek ..... 29/868
4,736,627 4/1988 Wicks, III et al. ..... 73/155
4,792,802 12/1988 Meadows ..... 340/856
4,811,888 3/1989 Ziemek et al. ..... 228/148
4,830,113 5/1989 Geyer ..... 166/369
4,842,064 6/1989 Gazda .
4,848,480 7/1989 Titchener et al. ..... 166/385
4,942,926 7/1990 Lessi ..... 166/385
4,976,142 12/1990 Perales ..... 73/155
4,998,663 3/1991 Cakmak et al. ..... 228/2
5,071,053 12/1991 Heijnen ..... 228/112
5,072,870 12/1991 Ziemek ..... 228/102
5,080,175 1/1992 Williams ..... 166/385
5,088,559 2/1992 Taliaferro ..... 166/379
5,094,340 3/1992 Avakov ..... 198/626.1
5,118,226 6/1992 Horii et al. ..... 406/194
5,119,089 6/1992 Khalil ..... 340/855.2
5,121,628 6/1992 Merkl et al. ..... 73/290 V
5,121,872 6/1992 Legget ..... 228/148
5,122,209 6/1992 Moore et al. ..... 156/54
5,140,318 8/1992 Stiner ..... 340/854.8
5,140,319 8/1992 Riordan ..... 340/854.9
5,145,007 9/1992 Dinkins ..... 166/386
5,146,982 9/1992 Dinkins ..... 166/65.1
5,163,321 11/1992 Perales ..... 73/151
5,176,207 1/1993 Keller ..... 166/64
5,180,014 1/1993 Cox ..... 166/384
5,184,682 2/1993 Delacour et al. ..... 166/385
5,186,048 2/1993 Foster et al. .
5,191,173 3/1993 Sizer et al. ..... 174/105 R
5,234,058 8/1993 Sas-Jaworsky et al. ..... 166/385
5,269,377 12/1993 Martin ..... 166/385
5,275,038 1/1994 Sizer et al. .
5,289,882 3/1994 Moore ..... 166/379
5,291,942 3/1994 Ryan ..... 165/104.12
5,294,923 3/1994 Juergens et al. ..... 340/854.9
5,329,811 7/1994 Schultz et al. .
5,348,097 9/1994 Giannesini et al. ..... 166/385
5,355,128 10/1994 Riordan ..... 340/854.7
5,377,747 1/1995 Didier ..... 166/65.1
5,380,977 1/1995 Yoshie et al. ..... 219/121.63
5,394,943 3/1995 Harrington ..... 166/373
5,410,106 4/1995 Nishino et al. ..... 174/105 R
5,429,194 7/1995 Nice ..... 166/383
5,435,395 7/1995 Connell ..... 166/384
5,457,988 10/1995 Delatorre .
5,485,745 1/1996 Rademaker et al. .
5,495,755 3/1996 Moore .
5,503,370 4/1996 Newman et al. ..... 254/134.3 FT
5,542,472 8/1996 Pringle et al. ..... 166/65.1
5,569,392 10/1996 Miyoshi et al. ..... 216/60
5,573,225 11/1996 Boyle et al. ..... 254/134.4
5,582,748 12/1996 Yoshie et al. ..... 219/121.64
5,599,004 2/1997 Newman et al. ..... 254/134.3 FT
5,661,402 8/1997 Chesnutt et al. ..... 324/338
5,699,996 12/1997 Boyle et al. ..... 254/134.4
5,767,411 6/1998 Maron ..... 73/705
5,778,978 7/1998 Crow ..... 166/254.2
5,809,916 9/1998 Strand ..... 166/77.2
5,821,452 10/1998 Neuroth et al. ..... 174/28
5,826,654 10/1998 Adnan et al. ..... 166/250.01
5,828,003 10/1998 Thomeer et al. ..... 174/69
5,835,929 9/1974 Suman .
5,848,642 12/1998 Sola ..... 166/77.2
5,855,062 1/1999 Kendall ..... 29/828
5,934,537 8/1999 Miller ..... 166/77.1 X
5,954,136 9/1999 McHugh et al. ..... 166/384

METHOD OF MAKING A CONDUCTIVE DOWNHOLE WIRE LINE SYSTEM

FIELD OF THE INVENTION

This invention relates to downhole wire line systems and, in particular, to a method of making a wire line system that includes small-diameter tubing with one or more signal and/or power conductors extending through the tube, and articles of manufacture useful in the method.

BACKGROUND OF THE INVENTION

Downhole instruments or tools for subterranean wells are lowered down a well bore and operated in a subterranean reservoir to measure, for example, formation characteristics such as bottom hole pressures and temperatures as a function of time, and to perform many other measuring, control and operational tasks in a well.

Tools of this type are typically lowered on a conductive wire line. The wire line is formed of coiled metal tubing ranging from ⅛"–½" in diameter, within which one or more conductors capable of transmitting a signal and/or power are located. These conductors can be insulated conductor wires, optical fibers or any other conductor capable of transmitting signals and/or power to or from a downhole location.

The use of electrical conductors within a wire line is known, and are described in U.S. Pat. Nos. 5,122,209 and 5,495,755, both of which are incorporated herein by reference. Because wire line tubing of this type comes in lengths greater than 10,000 feet, up to and longer than 20,000 feet, there has been difficulty in inserting the conductor in such lengths of tubing.

In the past, as described in U.S. Pat. No. 5,122,209, a plurality of electrical conductors have been formed within the coiled tubing by feeding a flat metal strip and the conductors simultaneously through a series of tube-forming dies, and then forming the tubing with the conductors in it by welding the elongated edges of the metal strip around the conductors. Such methods have proved useful in the past, but problems have arisen.

For example, fabrication of a wire-in-a-tube by using this method often resulted in an imperfection in the tube before the entire length of product is completed, which cannot be repaired. This adds significant cost to the manufacturing process because of the high scrap rate.

Moreover, with the advent of much deeper wells, those 16,000 feet and deeper, relatively small diameter tubing formed of a high strength material such as INCOLOY 825®, which has a relatively thick wall that is useful in such wells, cannot be formed with a conductor in it. Annealing the tubing and drawing it down in size are necessary for eliminating microscopic circumferential cracks in the weld and increasing the strength due to work hardening of the material. These steps cannot be performed with a conductor in the tubing.

Thus, there is a need for a method of making conductive wire line, especially those useful in today's deep wells, which eliminates these problems.

SUMMARY OF THE INVENTION

Problems discussed above have been solved by the invention described in detail below, which involves inserting a length of conductor into an elongated length of coiled metal tubing after the tubing is formed. The conductor can either be in the form of an insulated conductor wire, optical fibers, other conductors for conducting signals and/or power, or some combination thereof.

The invention includes the steps of inserting the tubing into a substantially vertical passageway such as a well bore, and providing an open upper end of the tubing that is accessible to an operator. The leading end of the conductor is inserted into the upper end of the tubing.

The leading end of the conductor includes an elongated weight connected to the conductor. The weight must be heavy enough to straighten the conductor so it can fall though the coiled tubing. The weight must also be flexible enough to move through small bends or other irregularities in the coiled tubing.

A weight capable of performing these functions is one that has essentially no stiffness so that it can fall freely through irregularities in the coiled tubing without imparting a side load onto the inner surface of the coiled tubing, which would prevent further downward movement. Such a weight can be formed of an elongated segmented structure such as a chain with interlocking links or the like.

In embodiments of the invention where the weight must be pushed initially into the coiled tubing, the weight must have a minimum bend radius that is great enough to prevent the segments of the weight from bunching up or jamming when a bend or other irregularity is encountered, but which has essentially no stiffness and does not impart a side load until the minimum bend radius is reached. A preferred form of such a weight is a chain with interlocking links that has been roll-formed to provide the characteristics described above.

After the conductor and weight are inserted into the coiled tubing, they are allowed to fall by gravity through the tubing at a controlled speed until the desired length of conductor is inserted in the tubing. In embodiments where, for example, the chain must travel through 90° or 180° bends before it can fall vertically in the tubing, a push tool can be used to assist the initial insertion of the chain into the tubing until there is enough weight in the tubing to allow the weight to fall by gravity and pull the conductor into the tubing.

The helical pitch of the coiled tubing is regulated so that the frictional contact between the outer surface of the conductor and the inner surface of the tubing is great enough to support the weight and conductor for preventing the conductor from breaking. After the conductor is inserted into the tubing, the conductive wire-line assembly is wound on a reel and is ready for use.

BRIEF DESCRIPTION OF THE DRAWINGS

The invention can be better understood when the detailed description of preferred embodiments described below are considered in conjunction with the appended drawings, in which.

DETAILED DESCRIPTION OF PREFERRED EMBODIMENTS

The invention relates to an improved method of inserting one or more conductors in a length of coiled tubing of the type used in conductive wire line for downhole operations. In broad general terms, the method involves inserting the conductor into the coiled tubing and letting the conductor fall by gravity after the tubing is run into a well or the like. The invention also relates to various articles of manufacture that are useful in performing the method.

Coiled tubing is a relatively small diameter metal conduit that is wound on a reel, which has a helical shape or residual curvature when the tubing is unwound from the reel due to an inherent memory in the metal. Conductive wire line is a length of coiled tubing used primarily in downhole applications, which includes one or more signal or power transmitting conductors extending through the coiled tubing.

Figure 1:
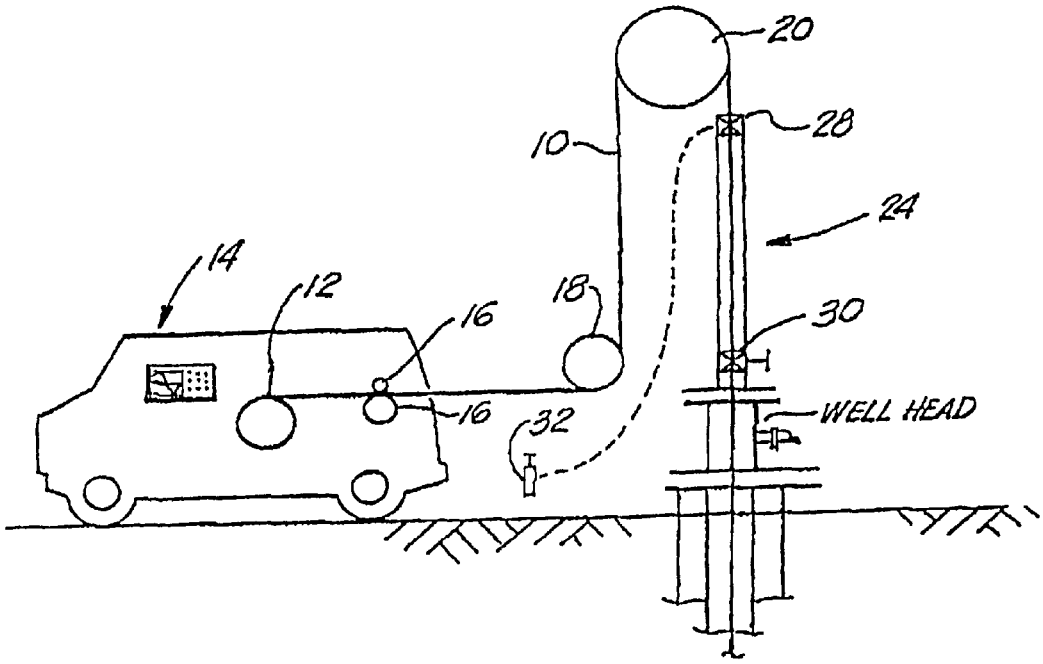
FIG. 1 is a schematic view of a conductive wire line being run into an underground well.
Figure 1:
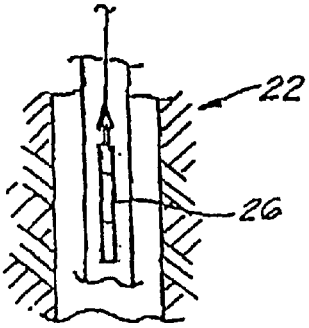

A typical use for conductive wire line is shown in FIG. 1, where a wire line 10 is spooled or coiled on a drum or reel 12 that is mounted on a wire line truck 14. The wire line 10 is unwound from the drum 12 and, after passing through rollers 16 and over sheaves 18 and 20, is lowered into an underground well 22 through a lubricator 24 and a well head. A tool 26, for example, a logging tool, is mounted on the end of the wire line 10 for performing a down hole operation.

The lubricator 24 includes a packing 28 at the upper end for forming a seal around the wire line 10 and an isolating valve 30 at the lower end for isolating the lubricator 24 from the well. A hydraulic pump 32 located outside the lubricator 24 pressurizes the packing 28 for effecting the seal.

Figure 2:
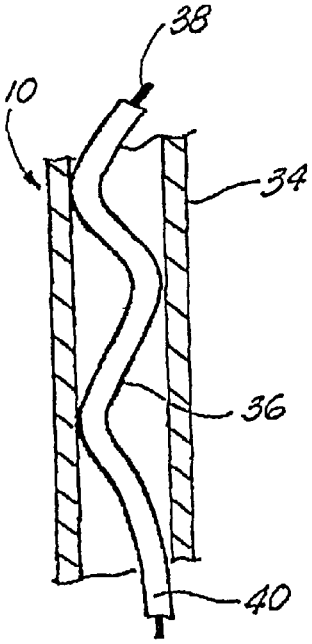
FIG. 2 is a sectional view of an insulated conductor inside a section of coiled metal tubing of the conductive wire line shown in FIG. 1.

As shown in FIG. 2, the wire line 10 is a conductive wire line formed of coiled tubing 34 and a conductor 36 that extends through the tubing 34, which is capable of transmitting signals or power. In use, the conductor 36 maintains a helical shape inside the tubing 34, due to its own inherent memory, which has the advantage of supporting the conductor 36 inside the tubing 34 through the frictional interface between the outer surface of the conductor and the inner surface of the tubing, as described in U.S. Pat. No. 5,495,755. Without this support, for the lengths typically used, the weight of the conductor 36 in the well bore is greater than its break strength. Thus, the conductor 36 cannot support its own weight and would break without this frictional hold-up force.

This inherent helical shape of the conductor is one of the problems that must be overcome if the conductor is to be inserted into the tubing in accordance with the present invention. Thus, unless the conductor is straightened, the conductor cannot fall by gravity through the coiled tubing. At the same time, however, there must be sufficient frictional contact between the outer surface of the conductor and the inner surface of the coiled tubing so that the weight of the conductor is supported by the tubing.

Moreover, when a length of coiled tubing in excess of 1,000 ft., and up to and greater than 20,000 ft., is unwound from a reel and suspended in a well, the coiled tubing also has an inherent helical shape. The conductor, in addition to being straight, must also be able to travel through the helical bends in the tubing and bends or curves caused by any irregularities in the well.

In addition to these problems, the difficulty of inserting conductors in coiled tubing that has already been formed can be appreciated considering the relatively small inner diameter of the tubing (an outer diameter of ⅛"–½" minus the wall thickness) and length of the tubing (greater than 1,000 ft. and up to and greater than 20,000 ft.), and the fragile nature of the conductors (e.g., insulated electrical wire, optical fibers and the like). The challenge is especially daunting for inserting a wire of, for example, about 0.055" in diameter in a length of coiled tubing in excess of 1,000 ft., and up to and greater than 20,000 ft., having an inner diameter as small as 0.089", which is less than two times the diameter of the conductor 36. The invention described in detail below provides a solution for this extremely difficult technical problem.

Figure 3:
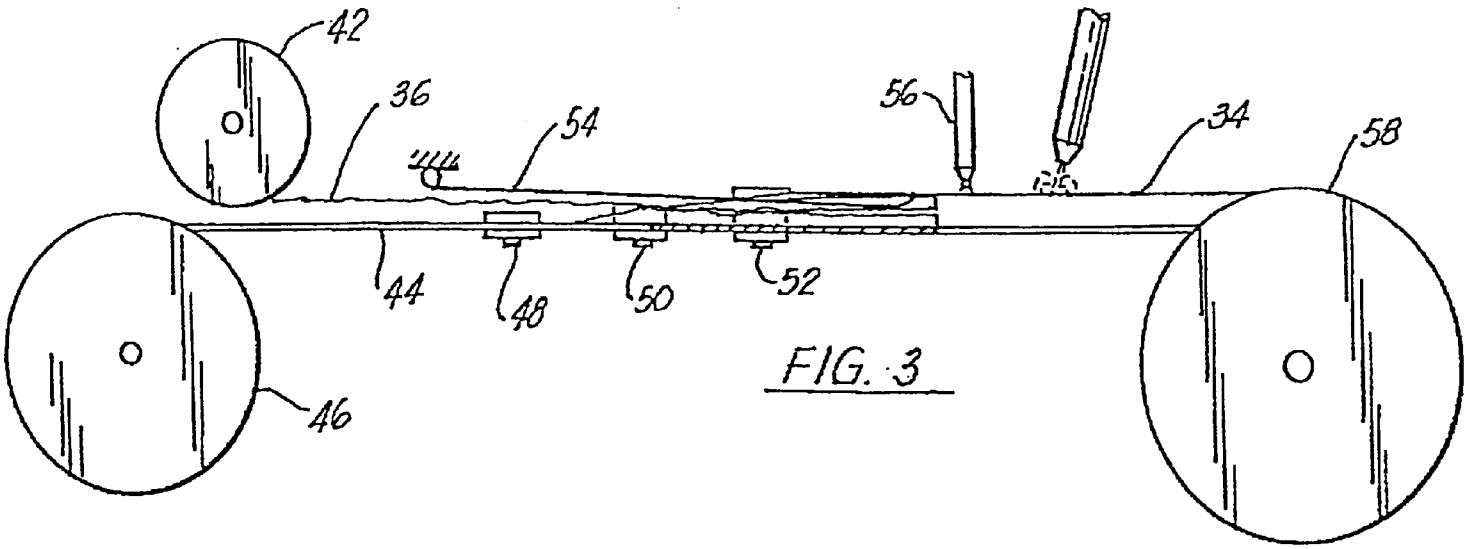
FIG. 3 is a schematic view of the conventional prior art method of forming conductive wire line.
Figure 4:
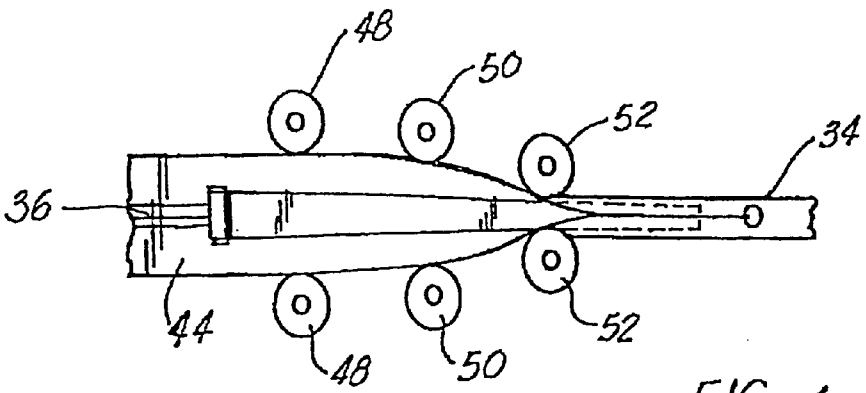
FIG. 4 is a schematic view of dies forming a strip of metal into coiled tubing in accordance with the method of FIG. 3.

In the past, such wire-in-a-tube, conductive, wire-line assemblies were manufactured by forming the tubing around a conductor, as described in detail in U.S. Pat. No. 5,122,209. Briefly, by way of background, FIGS. 3 and 4 illustrate the method described in that patent, in which a conductor 36 that is spooled on a reel 42 is fed simultaneously with a metal strip 44 that is spooled on a reel 46. The metal strip 44 and conductor 36 are fed through a series of rollers 48, 50 and 52, which bend and roll the strip 44 into the tubing 34, with the conductor 36 inside the tubing 34. A spring 54 extends into the tubing 34 before the edges of the strip 44 are welded together by a welding station 56, for protecting the conductor 36 from damage. The final wire-in-a-tube product is then wound on a reel 58.

While this process has been successful in forming conductive wire line, the process is expensive and prone to a high rejection rate. Oftentimes, an imperfection occurs along the length of the tubing. Such imperfections cannot be repaired, requiring that length of tubing to be scrapped, which adds substantially to the manufacturing costs of the final product.

The method of the present invention is an improvement over previously used methods of placing one or more conductors in coiled tubing. The method utilizes coiled tubing manufactured by conventional techniques without any conductors in it. Generally, this tubing is lowered in a conventional way into an underground well or other type of vertical passageway through which the tubing can extend. A conductor is then inserted into the tubing and allowed to fall by gravity through the tubing.

A novel weight formed of an elongated segmented structure with essentially no stiffness (described in greater detail below), is connected to the leading end of the conductor for pulling the conductor straight and providing sufficient weight for gravitational forces to cause the conductor to fall to the bottom of the tubing.

Preferably, this weight is formed of a chain with interlocking links, which has sufficient flexibility to pass through bends or other irregularities in the coiled tubing caused by its inherent helical shape, by irregularities in the well casing, or by other bends formed in the manufacturing and handling of the coiled tubing. A chain with interlocking links is also important because it can be formed with a relatively high density to reduce the length of the weight. Such a chain can also be formed with a minimum bend radius for preventing the links from bunching up or jamming when the chain must be pushed into the tubing to get it started when, for example, the conductor must pass though bends of 90° or 180° before it can fall vertically into the tubing. Details of a preferred embodiment of the weight are described in greater detail below.

The use of such a chain is the first time a known workable method has been developed for inserting one or more conductors in coiled tubing that is suspended in a well or the like. Although several prior art patents suggest some of the problems that might be encountered, no workable solutions were disclosed.

For example, in U.S. Pat. No. 3,835,929, a "guide means" is generally mentioned as being removably attached to the lower end of a cable to assure that the cable would not "kink" in the tubing. However, no structure is described for this so-called guide means. An alternative method involving pumping the cable through the tubing is mentioned, which does not work because a sufficient force cannot be applied to move the cable through the tubing.

In U.S. Pat. No. 4,616,705, for a different application where a thermocouple in an elongated wire is described as being lowered through coiled tubing extending along the outer surface of well casing, a sinker line formed of aircraft wire with beads crimped onto the wire about ½" apart, is described as being able to pull an elongated sensing means downward and straighten any bends in it. The wire, although it is said to be flexible, is too stiff to travel through short radius bends because it imparts a side load on the wall of the tubing due to its inherent stiffness. Thus, neither of these patents constitutes an enabling disclosure of a workable way of inserting a conductor in coiled tubing that has already been placed in a substantially vertical passageway by allowing the conductor to fall freely by gravity through any small bends or other irregularities in the tubing until the conductor is fully inserted.

Figure 5:
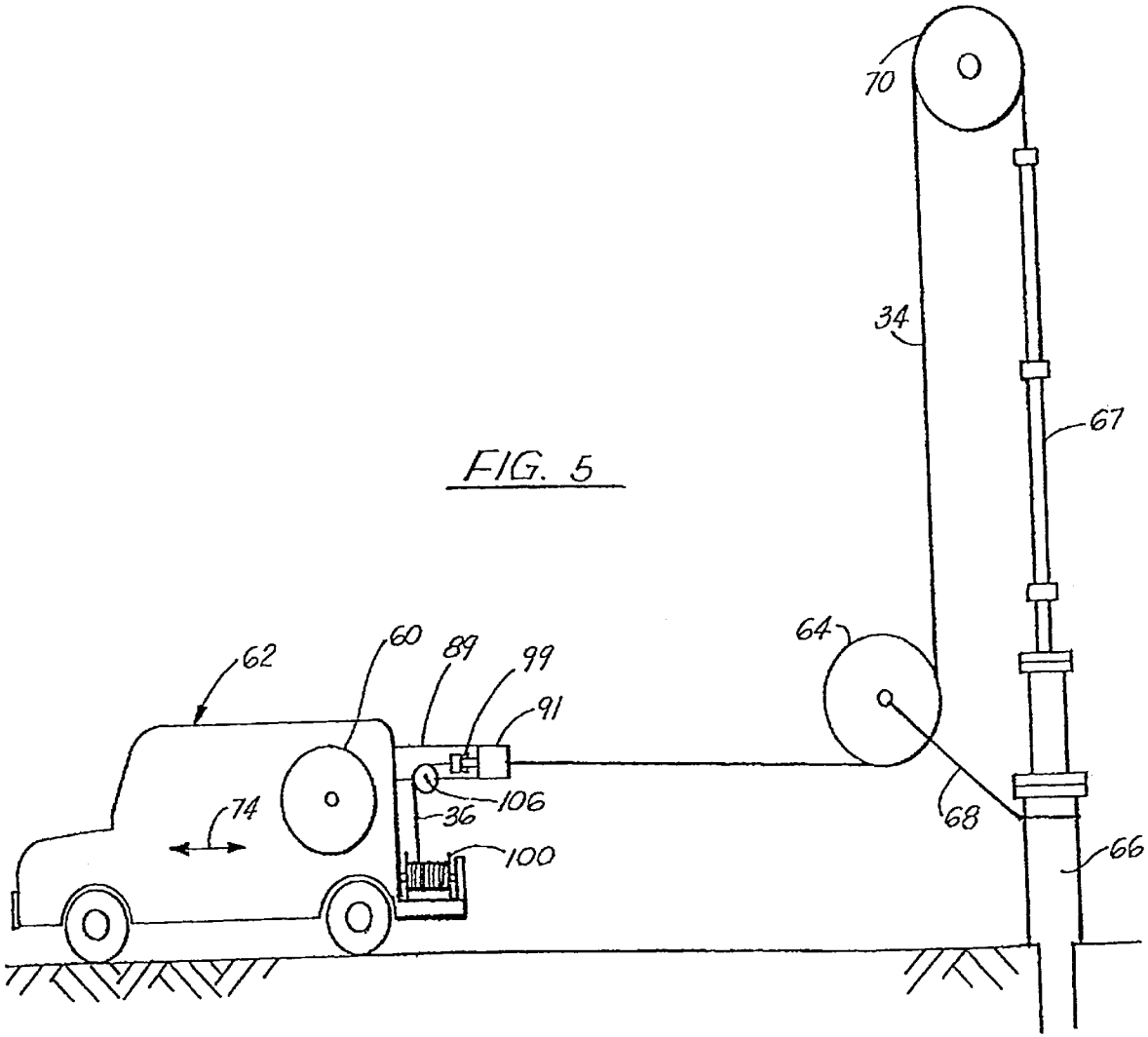
FIG. 5 is a schematic view, in accordance with the present invention, of conductor being inserted into coiled tubing that has been run into an underground well from a conventional wire line truck.

One way of performing the invention, which solves these problems, is shown in FIG. 5. The tubing 34 is spooled on a reel 60 that is mounted on a conventional wire line truck 62. The tubing 34 is transported to a well site or other location where a vertical passageway of suitable depth is situated. A second reel 100 on which conductor 36 is spooled can also be mounted on the wire line truck 62. Alternatively, a facility can be situated near a well site or the like for performing the function of the wire line truck 62.

The coiled tubing used in conjunction with the invention is preferably formed of stainless steel or nickel alloys, but other suitable materials known in the art can be used. This type of coiled tubing typically has an outer diameter of ⅛"–½". A material for which the invention is particularly useful is a high-strength nickel alloy used in deep wells (greater than 16,000 ft.) called INCOLOY 825® (a trademark of the International Nickel Company), which has an outer diameter of 3/16", and a relatively thick wall of about 0.049", resulting in an inner diameter of about 0.089".

The conventional method for placing a conductor in tubing of this type, which is described in above and shown in FIGS. 3 and 4, has been found to be unsuitable. After the tubing is initially formed, it is annealed and then drawn down to a smaller diameter for eliminating any minute circumferential cracks in the weld, refining grain structure of the material and making the tubing stronger through work hardening. These post-forming steps cannot be performed with the conductor in the tubing.

The type of conductor that can be used in conjunction with the invention is preferably an insulated copper wire 38 formed of stranded 20 gauge nickel-plated copper wire. The conductor 36 has an insulation covering 40 of polyimid tape (KAPTON® a trademark of DuPont), mill spec MIL-8138/12. A secondary coating of aromatic polyimid resin is applied in a known way to seal the tape and improve durability. However, a wide variety of other insulated electrical conductors could also be used.

Alternatively, the conductor 36 could be one or more optical fibers that are capable of transmitting signals. Other types of conductors could also be used. The invention contemplates encompassing any type of signal or power transmitting conductor, or some combination thereof, that is capable of being inserted in tubing and used in down hole applications.

Figure 6:
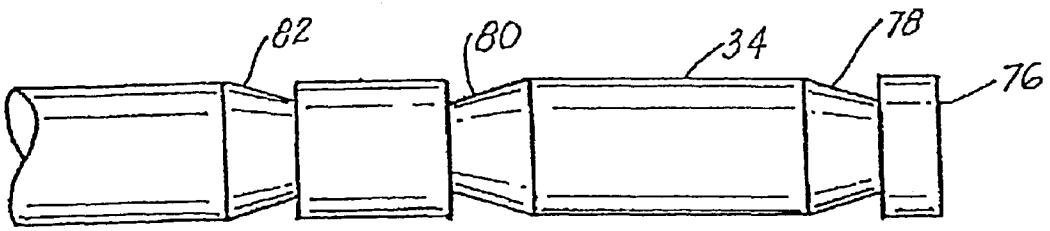
FIG. 6 is a plan view of the outer surface of the downhole end of the coiled tubing in FIG. 5, with its outer surface shaped by a forming tool in accordance with the present invention so that a weight in the form of a sinker bar can be connected to the tubing for pulling the tubing into the well bore and sealing the tubing.

The tubing 34 is run into the well in a known way, by first connecting a weight, such as known type of sinker bar 86 (see FIGS. 6 and 7), to the leading end of the tubing 34. The connection between the tubing 34 and the sinker bar 86 is formed by first preparing the leading end of the tubing 34 as shown in FIG. 6.

Figure 7:
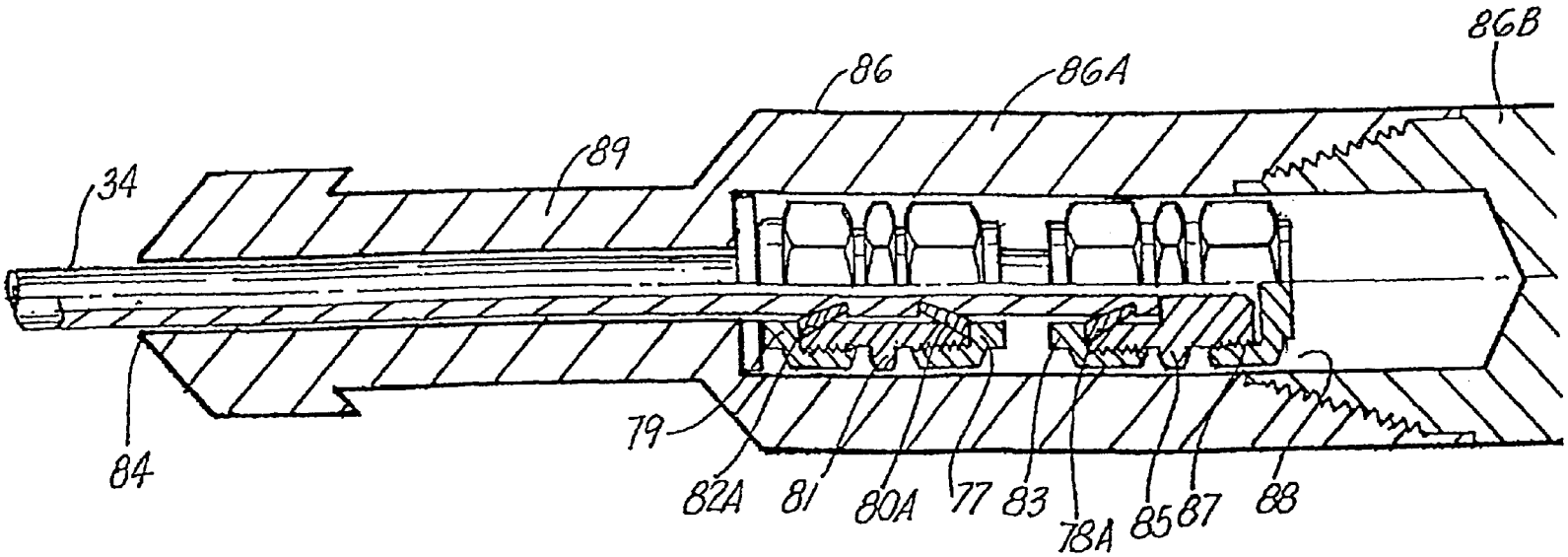
FIG. 7 is a partial sectional view of the weight connected to the tubing.

A forming tool (not shown) of the type shown and described in co-pending patent application Ser. No. 08/666,846, filed Jun. 6, 1996, now U.S. Pat. No. 5,907,966, entitled "Roll-Formed Seat and Retainer . . . ", which application is incorporated by reference herein as though fully set forth, is used to form tapered surfaces 78, 80 and 82 in the outer surface of the tube 34. The tube 34 is then inserted through an opening 84 formed in a the sinker bar 86, as shown in FIG. 7. The sinker bar 86 includes an upper section 86A that has a chamber 88 in which a known type of fitting made by Swagelok Corporation is used to connect the sinker bar 86 to the tubing 34 and seal the leading end of the tubing 34 from fluids in the well.

The Swagelok® fitting includes ferrules 78A, 80A and 82A for engaging the grooves 78, 80 and 82, respectively. The ferrules 80A and 82A are held in place between nuts 77 and 79, and a union 81. The ferrule 78A is held between a nut 83, a fitting 85 and a seal cap 87. The sinker bar 86 also includes a lower section 86B that is threaded onto the upper section 86A after the sinker bar is connected to the tubing 34 as described. The sinker bar also includes a fishing neck 89 for retrieving the sinker bar 86 from the well.

As shown in FIG. 5, the tubing 34 (including the sinker bar 86 connected its leading end), is passed over a lower sheave 64 that is connected through a cable 68 to a well head 66, and over an upper sheave 70 that is fixed to the lubricator 67. The lubricator 67 includes the packing, isolating valve and hydraulic pump shown in FIG. 1 for effecting a seal as discussed above, but these features have been omitted from FIG. 5 for ease of illustration.

As the tubing is unwound from the reel 60, it has a helical shape caused by the inherent memory of the material of the tubing. Initially, the weight of the sinker bar 86 straightens the coiled tubing 34 and pulls it into the well. After gravitational forces pull the sinker bar 86 and tubing 34 a certain distance, the weight of the tubing 34 in combination with the weight of the sinker bar 86 will straighten the tubing 34 and pull it to the bottom of the well or until the sinker bar 86 is stopped by a bridge plug (not shown) set at a desired depth in the well. At this point in time, when there is no pulling force acting on the coiled tubing 34, it will have a helical shape inside the lubricator 67 and in the well as shown schematically in FIG. 9.

Figure 8:
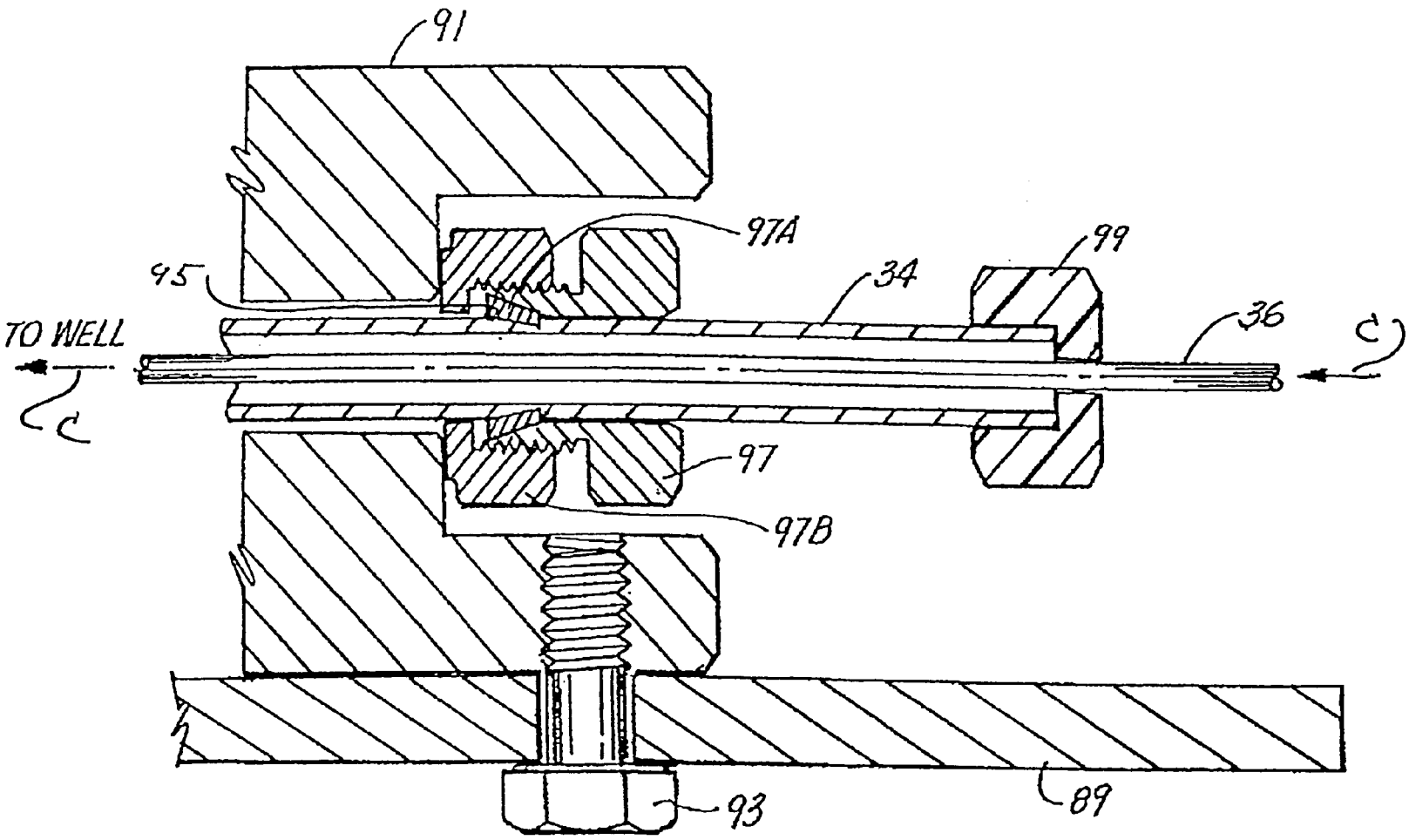
FIG. 8 is a partial sectional view of the connection between the exposed end of the coiled tubing and a holding fixture connected to the wire line truck.

The tubing 34 is then disconnected from the reel 60, and connected to the truck by using a holding fixture 91 like the one shown in FIG. 8, so that the conductor 36 can be inserted in tubing 34. Because the tubing is resting on the bottom of the well or on a bridge plug or the like in the well, the tubing 34 can be disconnected from the reel 60 and not held at the well surface. Alternatively, the tubing 34 could be held in place in the well by using known slips or the like.

The tubing 34 is then connected to the truck in this embodiment of the invention through an arm 89 that is connected to the truck 62. The tubing 34 is mounted in a holding fixture 91 that is connected to the arm 89 through a bolt 93. After a groove 95 is formed in the outer surface of the tubing 34 as shown in FIG. 8 by the same grooving tool mentioned above and described in pending U.S. patent application Ser. No. 666,846, filed Jun. 6, 1996, described above, a standard Swagelok® fitting 97 (including a ferrule 97A and backwards nut 97B) is used to connect the tubing 34 to the fixture. A plastic guide bushing 99 can be placed on the end of the tubing 34 for preventing the insulation or cladding on the outer surface of the conductor 36 from dragging on the sharp inside edge of the tubing 34 when it is inserted in the direction of arrow C as shown in FIG. 8.

Figure 9:
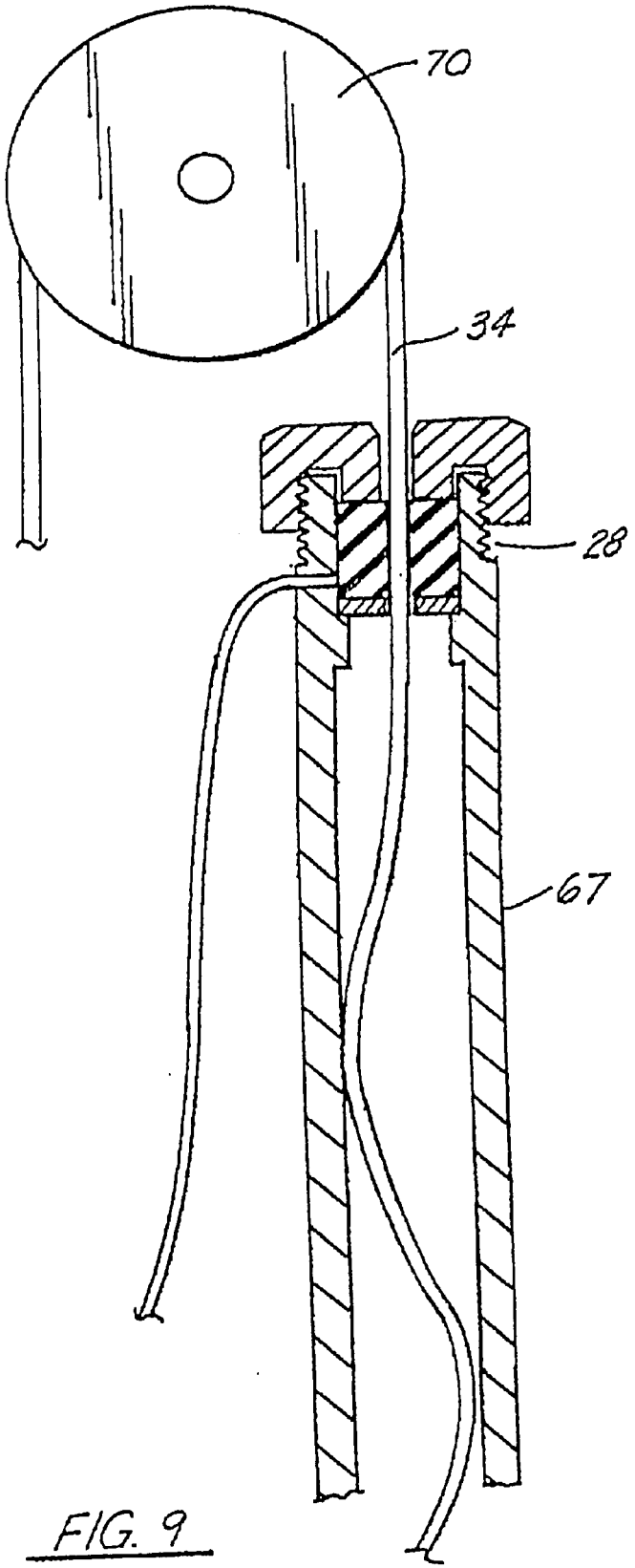
FIG. 9 is a partial sectional view of the coiled tubing in FIG. 5 inside a lubricator of an underground well showing in particular the helical shape of the tubing after it has hit the bottom of the well and the tension in the tubing is relaxed.

Because of the inherent memory of the coiled tubing 34, it maintains a helical shape in the lubricator 67 and in the well, as shown in FIG. 9, when the truck 62 is not pulling on the tubing 34 and holding it in tension. The pitch of this helical shape can be regulated, for the reasons discussed below, by moving the truck 62 back and forth as indicated by two-headed arrow 74 in FIG. 5, which movement straightens or relaxes the tubing 34.

Figure 11:
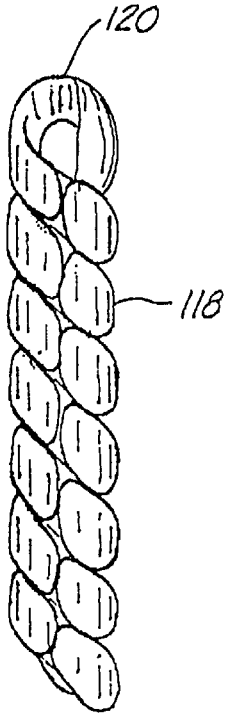
FIGS. 11 and 12 are front and side plan views of a section of jeweler's chain useful as a weight for lowering a conductor into the tubing.
Figure 13:
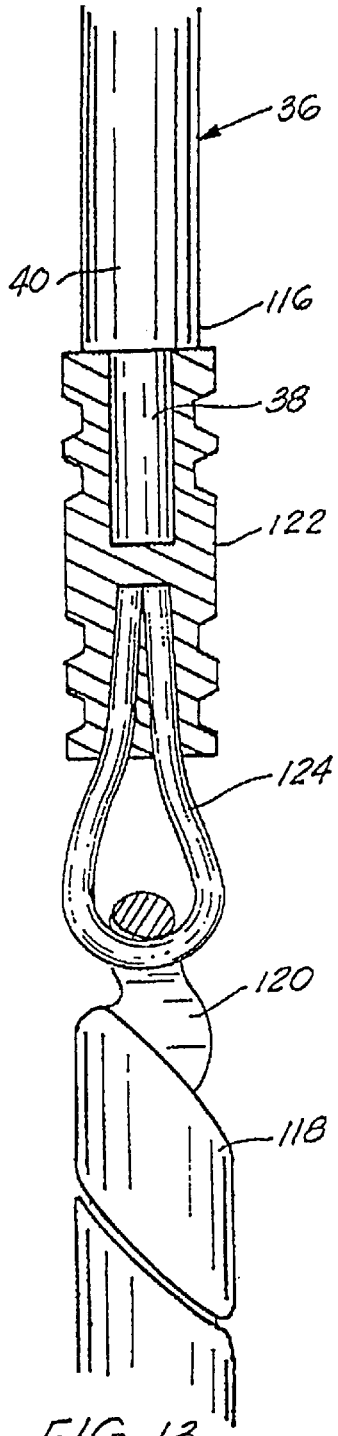
FIG. 13 is a partial sectional view of the connection between the chain of FIGS. 11 and 12 and the conductor.
Figure 12:
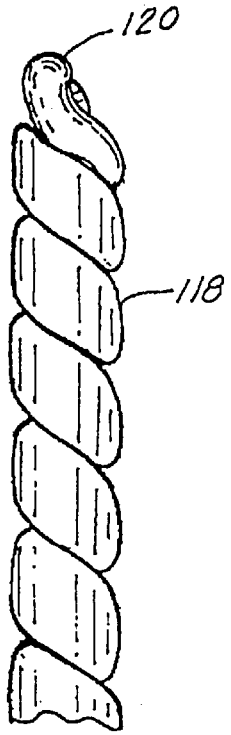

Before the conductor 36 is inserted into the coiled tubing, an elongated weight such as a chain 118 shown in FIGS. 11 and 12 is connected to the leading end 116 of the conductor 36 (see FIG. 13) for straightening the conductor 36 and pulling the conductor 36 into the tube 34. The elongated weight must have essentially no stiffness so that it can fall through small bends and other irregularities in the coiled tubing without imparting a side load onto the inner surface of the tubing, which would result in a frictional hold-up force. Such a weight can be formed of an elongated segmented structure such as a chain with interlocking links or the like. Alternatively, a beaded chain (not shown) of the type used as a pull for light fixtures could be used provided it had sufficient density to provide the needed weight. Segmented weights of these types have sufficient flexibility to pass through irregularities in the coiled tubing caused by its inherent helical shape or by irregularities in the well casing that cause bends in the coiled tubing.

Figures 13A, 14:
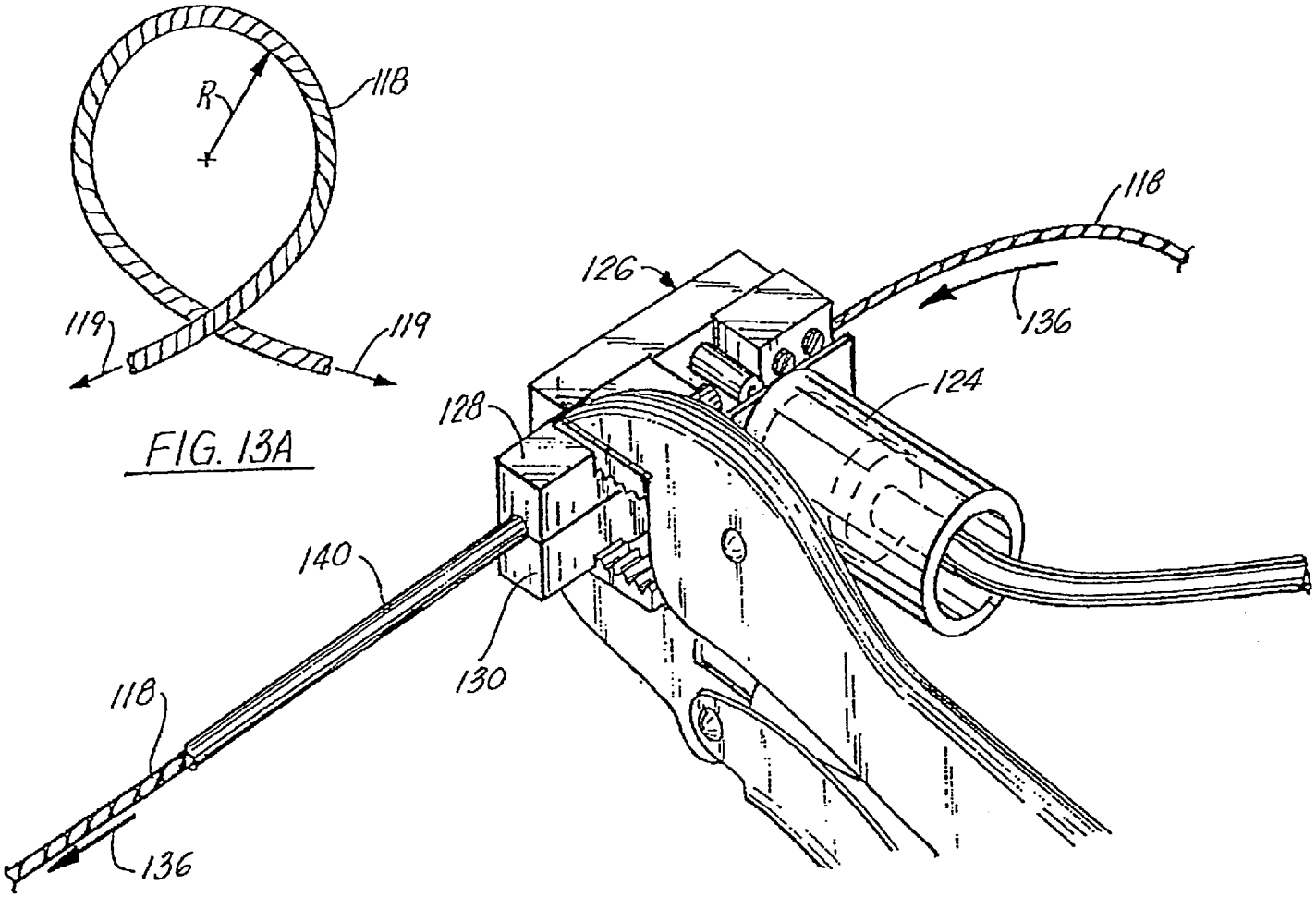
FIG. 13A is a schematic drawing showing a minimum bend radius in the chain of FIGS. 11 and 12.
FIG. 14 is a schematic view of the pusher tool for pushing the chain of FIGS. 11 and 12 into the tubing.
Figure 15:
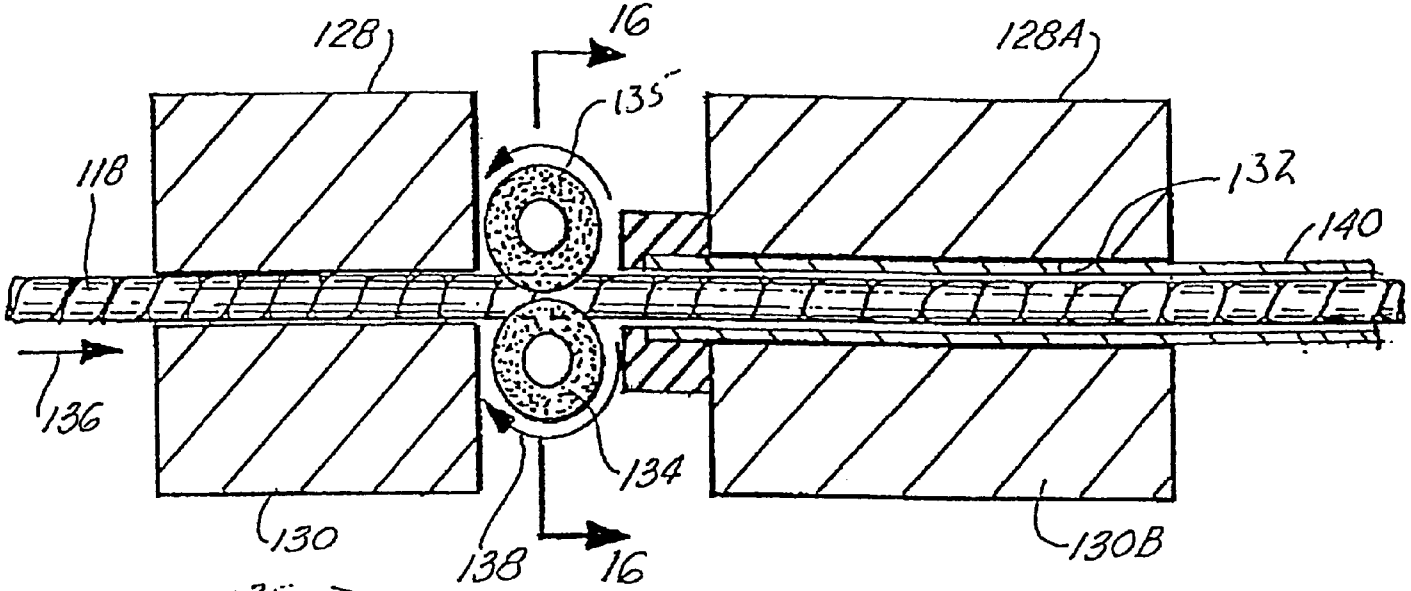
FIGS. 15–17 are partial sectional views of the pusher tool and chain in FIG. 14, showing in particular the chain being pushed into the tubing.
Figure 16:
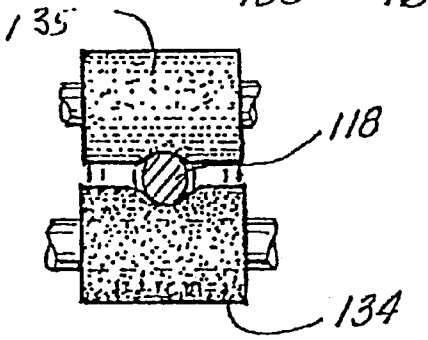

In embodiments of the invention where the weight must be pushed initially into the coiled tubing to get it started, for example, where it must pass through bends of 90° or 180° before it can fall vertically, the weight must be formed with a minimum bend radius for preventing the links from bunching up or jamming when such irregularities are encountered. The minimum bend radius of a chain of the type shown in FIGS. 11 and 12 is illustrated in FIG. 13A. The radius line R depicts the minimum bend radius of the chain 118 when it is looped, and the ends of the chain 118 are pulled in the direction of arrows 119 until the chain locks and will not bend any further.

A weight found to satisfy these requirements is 180 S.A. 54 jewelry chain, which is formed of brass. As shown in FIGS. 11 and 12, the links of this chain are different from the links in a conventional chain because they have been roll-formed into a round cross-sectional shape, to where the ends of each link are oriented at about 90° relative to each other as shown in the link 120 in FIG. 11. This shape substantially reduces the gaps between adjacent links and has the effect of providing a chain with a relatively high density (approximately 7 specific gravity), so that the weight has more weight per unit of length. A distinct advantage of this higher density chain is that a shorter length can be used to provide the required weight for initially pulling the conductor 36 into the tubing 34.

The interlocking links 120 can be compressed for controlling the minimum bend radius of the chain 118. For the purposes of the invention, a minimum bend radius is preferably set within a range of about ¼"–24", and more preferably at about 4". The chain can be purchased with the links already roll formed. The links can be compressed by passing the chain through a rolling mill of the type known to jewelers. A length of about 600 ft. of roll-formed brass chain (180 S.A. 54) with a minimum bend radius of about 4" (which weighed 6–7 lb.), was found satisfactory to perform the method in accordance with the invention as described.

An advantage of the roll-formed chain 118 shown in FIGS. 11 and 12 is that it can be pushed into the coiled tubing without bunching up and jamming when it reaches a bend or other irregularity. When the invention is performed in a well of the type shown in FIG. 1, which has a lubricator and well head, the ability to push the chain initially through 90° and/or 180° bends over several pulleys and into the well can be important.

However, if the chain can be dropped directly into the well as it is unwound from a reel, it might not have to be pushed. In such a case, the weight can be formed of a conventional linked chain that does not have any significant minimum bend radius. The interlocking links provide sufficient flexibility for allowing the chain to pass through small bends and irregularities in the tubing.

Although conventional linked chain can be used in such situations, a roll-formed and compressed chain of the type shown in FIGS. 11 and 12, where the links are twisted so that the ends of each link are oriented at 90° relative to each other, has the advantage that it has about twice the density of the conventional linked chain and is therefore about twice the weight per unit length, so that only half the length must be used.

The chain 118 with interlocking links constructed as described above, is connected to the leading end 116 of the conductor 36, as shown in FIG. 11, by using a known type of crimp connection. The insulation 40 is stripped from the leading end 116 exposing a short length of wire 38. The wire 38 is inserted into one end of a crimp connection 122. A loop of steel wire 124 is passed through the outside link 120 of the chain 118 and inserted into the other end of the crimp connection 122. A known crimping tool (not shown) is used to crimp the connection 122 onto the wire 38 and wire loop 124 for connecting the chain 118 to the wire 38.

The chain 118 is then introduced into the tubing 34. However, because the tubing 34 is not, in many cases, located directly over the well, an assist in such cases must be provided for the chain 118. An assist found to be useful is provided by a push tool 126 of the type shown in FIGS. 14–17. The push tool 126 frictionally engages the outer surface of the chain 118 and pushes it into the tubing 34 a sufficient distance until gravitational forces begin acting on the chain 118 and cause it to fall of its own weight. The push tool 126 should be able to push at least 70–100 ft. of chain into the tubing 34.

Figure 17:
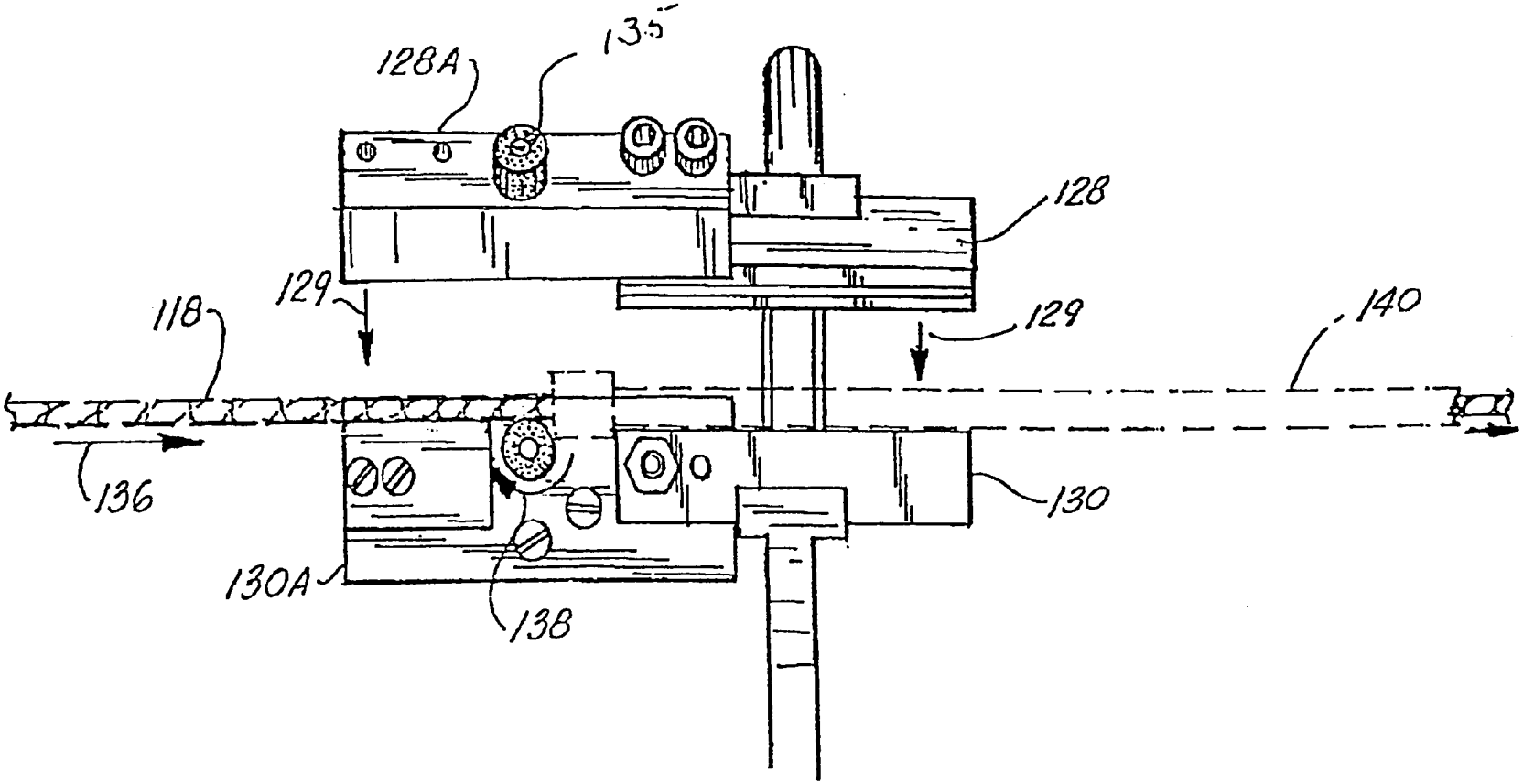

As shown in FIGS. 12–15, the push tool 126 includes a pair of gripping jaws, such as those provided by a pair of VICE-GRIPS®, on which a pair of guides 128 and 130 are mounted. The guides 128 and 130 and guide extensions 128A and 130A (FIG. 17) form a hollow opening 132 through which the chain 118 can pass, when the guides are closed by moving the guide 128 in the direction of arrow 129 as shown in FIG. 17. A small electric motor 124 is connected to one of the guide extensions 130A, which drives a wheel 134 formed of rubber or other compressible elastomer. As the chain 118 passes between the drive wheel 134 and an adjacent idler wheel 135, rotation of the drive wheel 134 in the direction of the arrow 138 pushes the chain 118 in the direction of the arrows 136.

A guide tube 140 positioned between the guide extensions 128A and 130A guides the chain 118 into the tubing 34. After the chain 118 is pushed into the tubing 34 a sufficient distance, gravity will begin operating on the chain 118 so that it falls of its own weight. The wire line truck 62 is moved in the direction of the arrow 74 (FIG. 5) to adjust the helical pitch of the tubing 34 for maintaining an acceptable tension in the conductor 36 below its break strength resulting from the frictional contact between the outer surface of the conductor 36 and the inner surface of the tubing 34.

Figure 10:
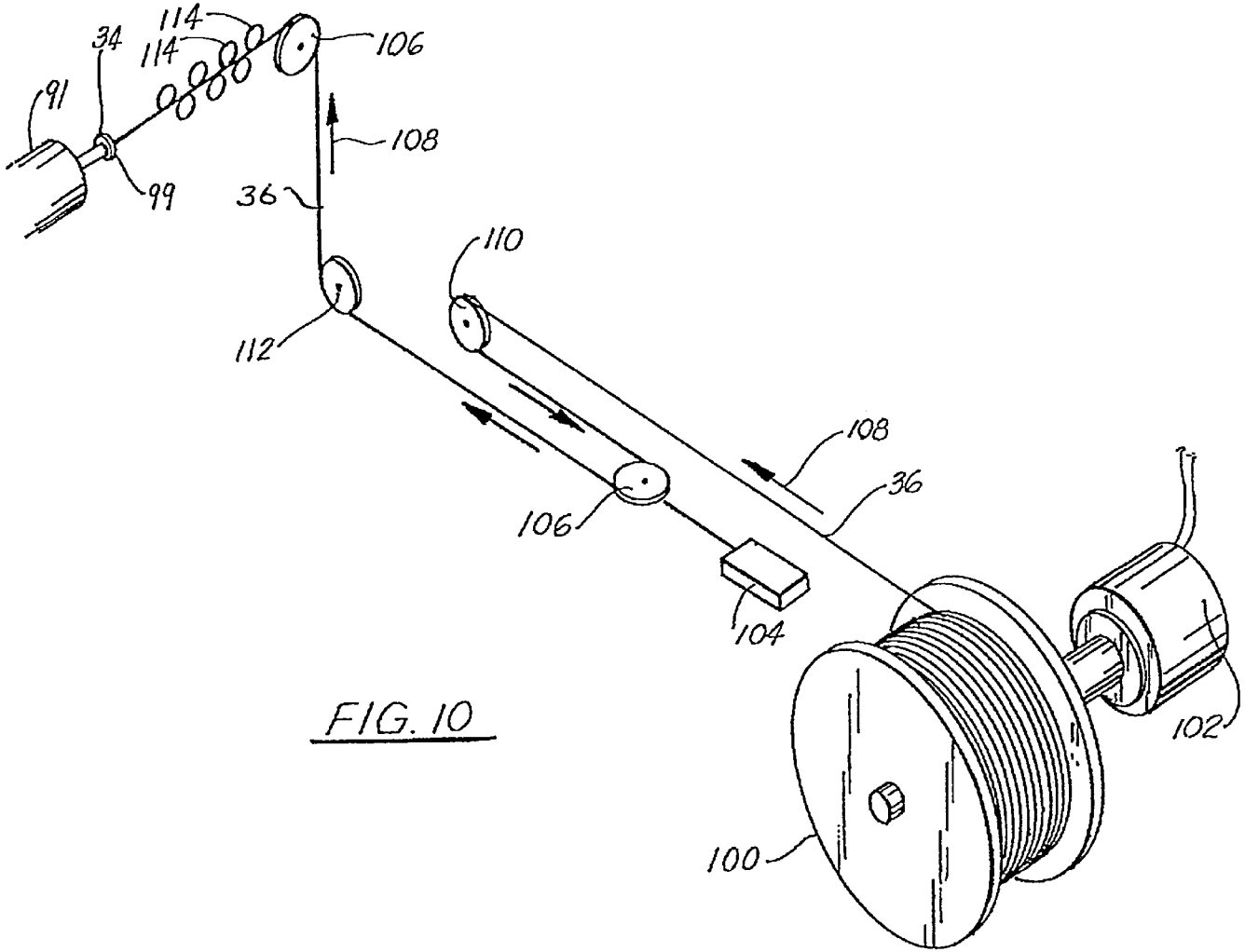
FIG. 10 is a schematic view of a conductor extending into the coiled tubing and being unwound from a reel.

The rate of descent of the chain 118 and conductor 36 (preferably at about 200 ft./min.) is governed by a gear motor 102 connected to the reel 100, shown in FIG. 10, which controls the rate of rotation of the reel 100. Thus, if the pitch of the helix in the tubing is maintained constant, the tension in the conductor (e.g., the weight of the chain 118 and conductor 36 being supported in the tubing by the conductor) will be maintained at a constant level during the entire insertion process. The gear motor 102 regulates the speed of descent and the helical shape of the tubing 34 supports the weight of the conductor 36.

For an insulated electrical conductor wire of the type described above, the break strength is about 60 lb., which is less than the combined weight of the conductor 36 and the chain 118 after the conductor 36 is inserted to predetermined depth. However, by regulating the pitch of the tube 34, the conductor 36 is able to support its own weight and will not break as it falls by gravity through the tube 34.

As shown in FIG. 10, as the conductor is unwound from the reel 100, it moves in the direction of arrows 108, over idler pulleys 110, 112 and pulley 106, through alignment rollers 114, and into the tubing 34 which is mounted in the holding fixture 91. A tension indicating device in the form of a scale 104 can be connected to the conductor 36 through the pulley 106 for maintaining a continuous reading of the tension load in the conductor 36, which is an indication of the weight being carried by the conductor 36. It was found that a weight of about 3–12 lbs. carried in a conductor having a break strength of about 60 lbs., provided a workable range.

After the conductor 36 is completely inserted into the tubing 34, the tubing 34 is then re-connected to the reel 60 and the wire-in-a-tube is removed from the well and wound on the reel 60. Thus, a conductive wire-line assembly is formed in a way that eliminates the need to place the conductor in coiled tubing as it is formed, which has the advantages described above.

While a preferred embodiment for practicing the invention has been described, it should be understood that there are many modifications, variations and improvements that can be made that are within the spirit and scope of the invention, and that all such modifications, variations and improvements are contemplated as being covered by the appended claims.

I claim:

1. A method for inserting at least one conductor into an elongated length of metal coiled tubing, comprising the steps of:

(a) placing the coiled tubing in a substantially vertical passageway;

(b) inserting said conductor into the tubing, the leading end of the conductor including an elongated weight connected to the conductor, which weight is heavy enough to straighten the conductor enough to fall through the tubing, the weight having essentially no stiffness so that it is flexible enough to move through bends or irregularities in the tubing;

(c) allowing the conductor and weight to fall by gravity through the tubing, which has a sufficient helical pitch providing a hold-up force due to friction for preventing the conductor from breaking, until the desired length of conductor is inserted in the tubing; and (d) removing the tubing with the conductor inside the tubing from the passageway and winding the tubing on a reel.

2. The method of claim 1, wherein the step of inserting a conductor includes inserting one or more insulated electrical conductor wires.

3. The method of claim 1, wherein the step of inserting a conductor includes inserting one or more optical fibers.

4. The method of claim 1, wherein the step of inserting a conductor includes inserting a combination of insulated conductor wires and optical fibers.

5. The method of claim 1, wherein the step of placing the coiled tubing includes the step of inserting at least a 1,000 ft. length of coiled tubing into a subterranean well bore.

6. The method of claim 5, wherein the step of placing the coiled tubing includes the step of inserting coiled tubing that has an outer diameter of ⅛"–½".

7. The method of claim 5, and further including the steps of disconnecting the tubing from a reel mounted on a truck and connecting the coiled tubing to the truck.

8. The method of claim 1, wherein the step of inserting the conductor includes the step of connecting a weight having an elongated segmented structure to the leading end of the conductor and inserting the weight into the tubing.

9. The method of claim 8, wherein the weight is formed of a chain having interconnected links.

10. The method of claim 9, wherein the chain is roll-formed and has a minimum bend radius.

11. The method of claim 10, wherein the chain has minimum bend radius of about ¼"–24".

12. The method of claim 1, wherein the step of allowing the conductor and weight to fall by gravity includes the step of regulating the tension in the tubing so as to regulate the pitch of the helical shape of the tubing so that the frictional hold-up force between the outer surface of the conductor and the inner surface of the tubing is sufficient for the conductor to support its own weight in the tubing.

13. The method of claim 12, wherein the step of regulating the tension in the tubing includes the step of moving a truck to which the coiled tubing is connected.

14. The method of claim 1, wherein the step of allowing the conductor and weight to fall by gravity further includes the step of controlling the speed the conductor is allowed to fall.

15. The method of claim 14, wherein the step of controlling the speed includes the steps of operatively connecting a reduction gear motor to the reel from which the conductor unwinds and operating the motor at a predetermined speed.

16. The method of claim 1, wherein the step of inserting the conductor into the tubing includes the step of pushing the weight into the tubing until the weight can fall vertically through the tubing.

17. The method claim 16, wherein the step of pushing the weight includes the step of pushing the weight around at least one 90° bend in the tubing.

18. The method of claim 16, wherein the step of pushing includes the step of engaging the weight between a pair of rollers, and rotating at least one of the rollers for moving the weight through the tubing.

19. A method for inserting at least one insulated electrical conductor wire into a length of small-diameter coiled tubing extending substantially vertically in a subterranean well, said tubing having an inner diameter less than about two-times the diameter of the conductor wire, comprising the steps of:

(a) connecting a weight to the leading end of the conductor wire, said weight being formed of a segmented structure having essentially no stiffness and being heavy enough to maintain the conductor straight enough to fall by gravity through the tubing;

(b) inserting the weight into the tubing and allowing the weight and conductor to fall by gravity through the tubing; and (c) maintaining a helical pitch in the tubing sufficient to impart a frictional hold-up force between the outer surface of the conductor and the inner surface of the tubing for preventing the conductor from breaking due to its own weight.

20. The method of claim 19, wherein the step of connecting a weight includes connecting a weight formed of a chain having interconnected links.

21. The method of claim 20, wherein the step on connecting a weight includes connecting a roll-formed chain with a minimum bend radius.

22. The method of claim 21, wherein the step of connecting a weight includes connecting a roll-formed chain with a minimum bend radius of about ¼"–24".

23. The method of claim 19, wherein the step of maintaining a helical pitch includes the step of regulating the tension in the tubing.

24. The method of claim 23, wherein the step of regulating the tension includes the step of moving a truck to which the coiled tubing is connected.

* * * * *